United States Patent [19]

Hoffman

[11] 4,027,647

[45] June 7, 1977

[54] PLANING AND CUTTING TOOL

[76] Inventor: Herbert H. Hoffman, 598 G Avenida Majorca, Laguna Hills, Calif. 92653

[22] Filed: Feb. 23, 1976

[21] Appl. No.: 660,725

Related U.S. Application Data

[63] Continuation-in-part of Ser. No. 487,916, July 12, 1974, abandoned.

[52] U.S. Cl. ..... 125/6; 29/81 G; 29/81 D; 125/40

[51] Int. Cl.² ..... B28D 1/22

[58] Field of Search ..... 125/6, 40, 41, 9; 51/209; 29/81 D, 81 G

[56] References Cited

UNITED STATES PATENTS

| | | | |
|---|---|---|---|
| 298,598 | 5/1884 | Mann | 125/9 |
| 1,223,064 | 4/1917 | Meader | 29/81 G X |
| 1,537,358 | 5/1925 | Lartigue | 125/6 |
| 1,727,915 | 9/1929 | Thompson | 29/81 D |
| 2,546,768 | 3/1951 | Mills | 29/81 D |
| 2,597,187 | 5/1952 | Roshoug | 51/209 R |
| 3,589,352 | 6/1971 | Carlsson | 125/6 |

FOREIGN PATENTS OR APPLICATIONS

| | | | |
|---|---|---|---|
| 452,458 | 5/1913 | France | 125/6 |
| 427,220 | 3/1926 | Germany | 125/41 |
| 523,016 | 11/1953 | Italy | 125/41 |
| 10,790 | 12/1898 | Sweden | 125/6 |

*Primary Examiner*—Harold D. Whitehead
*Attorney, Agent, or Firm*—Poms, Smith, Lande & Glenny

[57] ABSTRACT

A cutting tool is especially adapted for use with a power driven hammer. The power driven hammer is held in one hand and the shank of the tool is inserted into a guide on the hammer. Preferably, the power driven hammer is adapted to move the tool through a very short distance at a very high frequency so that each individual movement transmitting force on the tool will be short. The tool body has cutting teeth for cutting into the workpiece under action of the tool. The depth and speed of cut of the tool can be varied in a number of ways. In one embodiment, the teeth have a plurality of laterally flat cutting edges disposed in a longitudinally curved array, and the angle which the tool makes with the workpiece determines the depth and speed of the cutting. In a second embodiment, the teeth are disposed in a substantially flat plane, and a pivot is provided to transmit force from the anvil to the tool through the shank therebetween. The vertical and horizontal force components are variable in this embodiment without varying the inclination of the tool body toward the workpiece.

8 Claims, 7 Drawing Figures

PLANING AND CUTTING TOOL

BACKGROUND OF THE INVENTION

This application is a continuation-in-part of application Ser. No. 487,916 filed July 12, 1974, and now abandoned.

Tools have been provided in the past for chipping concrete or planing wood or other materials. The conventional concrete planing tool is held perpendicular to the surface and removes material from an area equal to the area of the tool. To plane a large area, the tool is moved to a different location on the work surface, and the process is repeated until the entire surface is planed. There is a tendency to have the removed material remain between the tool and the concrete which causes less efficient operation of the tool. Moreover, the requirement of separate areas of planing for each planing operation tends to yield an uneven surface with somewhat distinct tool placement areas. It is very difficult to vary the depth of cut of the tool.

Other prior art devices have been provided for other operations such as scraping. In the removal of paint from wood, for example, it is common to do the job manually using a hand-held scraping tool. This is slow and tedious. Sanding has been used but removed paint has a tendency to collect on the abrasive and prevent further use of the sheet of sandpaper.

Therefore, it is an object of the present invention to overcome the problems associated with the prior art devices. Specifically, it is an object of this invention to present a chipping or planing tool which may be used to remove small amounts of concrete or other material and will leave the material surface in a rather smooth, finished condition. It is a further object of the invention to provide a compact and lightweight tool, especially one which can be used on surfaces other than horizontal ones. Still a further object of the invention is to provide a planing or chipping tool which will dispose of the removed material in such a manner that it will not interfere with further removal of material by the tool.

An important object is to provide a tool that is propelled by the hammer in the forward direction along the workpiece at a controlled rate. It is primary objective to provide a tool with which speed and depth of cut can be varied instantaneously merely by altering the vertical and horizontal components of the force from the tool to the workpiece.

SUMMARY OF THE INVENTION

A cutting tool generally for use with a power driven hammer has a driven anvil member and means associated therewith for positioning a shank thereto in force transmitting relation. The tool comprises a shank for positioning to the power hammer anvil member in force transmitting relation and a tool body which has cutting teeth associated therewith for cutting into the workpiece under action of the tool. Means are also provided for connecting the shank to the rear of the tool in force transmitting relation at an angle inclined thereto. The connecting means may comprise a pivotal force transmitting connection so that the vertical and horizontal force components of the power driven hammer are variable without varying the inclination of the tool body toward the workpiece. The angle which the shank makes with the tool body is between about 5°–85°, preferably between 10°–60°, and the axis of the shank should extend between the front and rear teeth.

If the pivotal force transmitting connection is used, the cutting teeth have a plurality of cutting edges disposed in a substantially flat plane. If no pivotal force transmitting member is used, the cutting edges of the teeth are disposed in a longitudinally curved array. The teeth are progressively wider spaced vertically from the rear to the front with equal horizontal spacing. A cutting disposal groove is provided between each of the adjacent edges of the cutting edge. The cutting disposal groove may be laterally relieved from the plane of the cutting edges to facilitate disposal of removed material. Each cutting tooth has a forward face and a bottom face which intersect in a cutting edge. The forward faces are parallel with each other and the bottom faces are parallel with each other.

DETAILED DESCRIPTION OF THE PREFERRED EMBODIMENT

A cutting tool is generally used with a power driven hammer having a driven member and means associated therewith for positioning a shank thereto in force transmitting relation. Preferably, the tool of the instant invention is to be used with a power hammer similar to the one disclosed in U.S. Pat. No. 3,474,871, to Herbert H. Hoffman entitled "Power Hammer" although the tool could be used with other power hammers or it could be used manually. The power hammer disclosed therein is capable of frequencies of between 10,000 and 15,000 cycles per minute. Preferably, the length of the stroke is less than 0.050 inch. The reason that the aforementioned power hammer is preferable to other driving mechanisms will be set forth in detail below.

Figure 1:
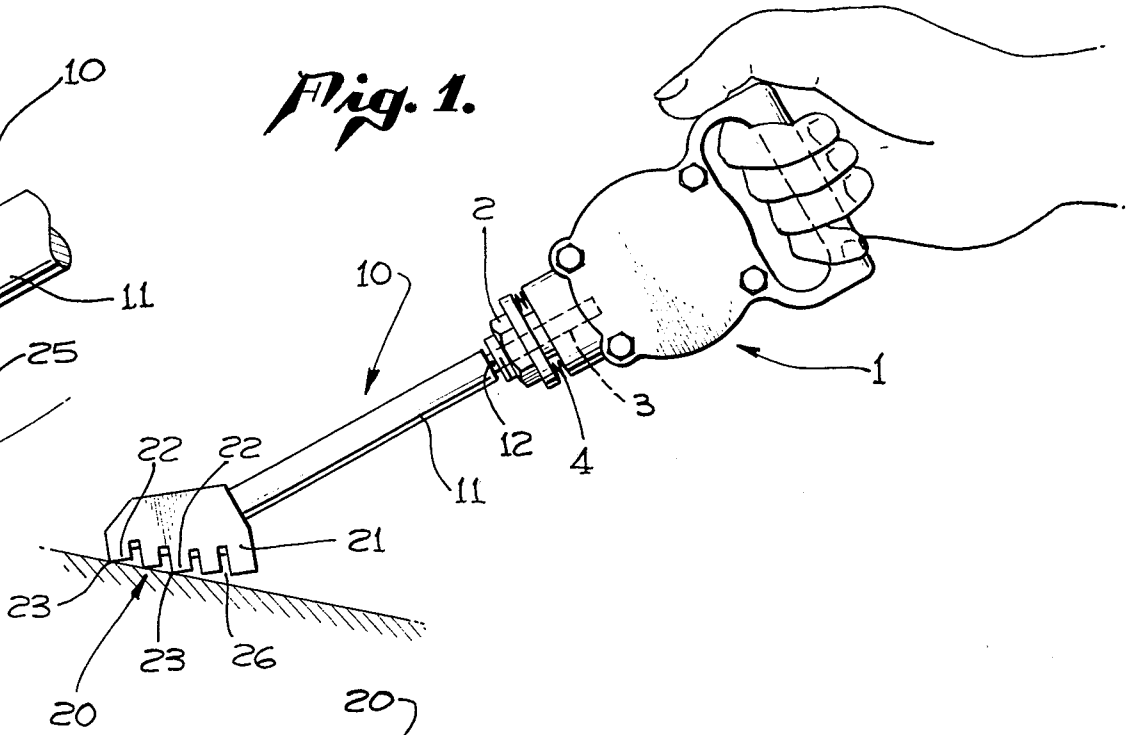
FIG. 1 is a side view of the preferred embodiment of the cutting tool of the present invention showing its relation to the power driven hammer.

Referring now to FIG. 1, the operator is holding the power driven hammer 1 in one hand and is holding the cutting tool 10 in the guide 3 of anvil 2 of the power hammer. The cutting tool includes shank means for positioning the tool to the power hammer in force transmitting relation. It is apparent that the tool is useful with many different power hammers having different force transmitting means. In the exemplary embodiment, the shank is positioned to the anvil member 2 of the power hammer of the aforesaid U.S. Pat. No. 3,474,871. The driven anvil member has means associated therewith for positioning the shank thereto in force transmitting relation. In the exemplary embodiment, the tool 10 includes a shank 11 which the operator holds in the guide 3 of the anvil 2. In the exemplary embodiment, the shank has a narrowed portion 12 to fit into the guide 3 of the power hammer anvil. The shank 11 is not securely held by the guide 3, and springs 4 maintain the anvil 2 away from the hammer heads (not shown) of the power hammer, but pressure from the shank on the hammer, when the tool is on a workpiece and the hammer is pushed thereagainst, compresses the spring and brings the anvil into contact with the hammer heads. If the tool of the present invention were used with power hammers without anvil members, the connection between the shank and the power hammer would be modified in accordance with the method of using such other power hammers.

A tool body having cutting teeth means associated therewith is provided for cutting into a workpiece under action of the tool. In the exemplary embodiment, the teeth 22 extend from the head 21 of the tool body. The teeth 22 have sharpened cutting edges 23 of either tool steel or carbide at the bottom front thereof. These cutting edges 23 cut into the workpiece and remove the material therefrom. The edges 23 of cuttng teeth 22 are formed by the intersection of forward faces 29 and bottom faces **29*a* which can intersect perpendicularly as in FIG. 2, at a slight angle as in FIG. 4, or in similar configurations. The angled intersection (FIG. 4) yields a clearance angle of face 29*a* with respect to the cutting surface which can vary from 0°–15°. The forward faces 29 are all parallel and the bottom faces 29*a* are parallel. Face 29*a* intersects face 29*b* which is spaced from face 29 of the next cutting tooth to form cutting disposal groove 26** which will be further discussed below.

Figure 3:
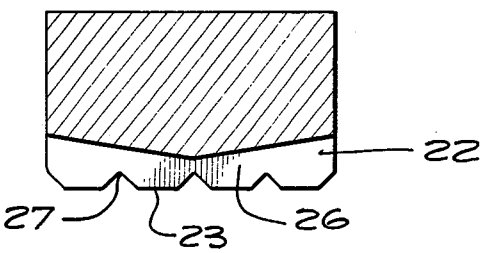
FIG. 3 is a cross-sectional view through the tool body taken along plane III—III in FIG. 2.

In one embodiment of the invention, the plurality of cutting edges are disposed in a substantially flat plane and a cutting disposal groove is provided between each of the adjacent edges of the cutting edges. Exemplary of this embodiment of the invention, the tool body 20 shown in FIG. 4 has the cutting edges disposed in a flat plane indicated at 24. The cutting disposal groove 26 is provided between each of adjacent edges of the cutting edges. The cutting disposal grooves taper from the center of the tooth to widen at the sides of the tooth. In the exemplary embodiment, indicated at FIG. 3, the cutting edge 23 and disposal groove 26 are shown. The groove is narrowest at the center of the tool body (FIG. 3) and widens toward the sides thereof. By so laterally relieving the groove and because of the vibration of the tool, chips or removed materials flow smoothly away from the tool.

In a second preferred exemplary embodiment, the plurality of cutting edges are disposed in a longitudinally curved array thereof. The exemplary embodiment of this invention is shown in more detail in FIG. 2 wherein the cutting edges are disposed in the longitudinally curved array indicated at 25. The importance of the curvature will be discussed in more detail hereinafter.

Means are provided for connecting the shank means and the tool body means in force transmitting relation. In one preferred structure of the invention, the means for connecting the shank means and the tool body comprises a pivotal force transmitting connection whereby the vertical and horizontal force components of the power driven hammer are variable without varying the inclination of the tool body toward the workpiece. Normally, the angle which the shank intersects the tool body is varied between 10°–60° (relative to the workpiece) although angles of 5°–85° are possible depending on speed and depth of cut desired. Usually, the angle is limited between 20°–40° for optimum performance and the extensions of the axis of the shank intersects between the front and rear cutting teeth. In this exemplary embodiment shown in FIG. 4, the shank means terminates in a connecting means. Preferably, the connecting means in this embodiment includes a pivoting member 31 which is free to pivot about pin 32 which is held between upstanding portions 33 of the tool body 20. The upstanding members 33 form a slot 34 in which the pivot member 31 is free to pivot.

In this embodiment, the tool body is provided with a handle which the operator can hold to exert more force on the workpiece. The depth of cut and speed of cut will vary depending on the angle which the shank 11 makes with the workpiece. The operator can vary this by varying the position of the power hammer. However, normally, initial cutting is started by raising the angle of the shank to concentrate force on the rear tooth. The large angle increases the vertical force component. After the initial cutting, the shank is pivoted downward to provide larger horizontal forces. The extension of the shank axis passes through the central cutting tooth to equalize cutting forces for optimal cutting.

Figure 2:
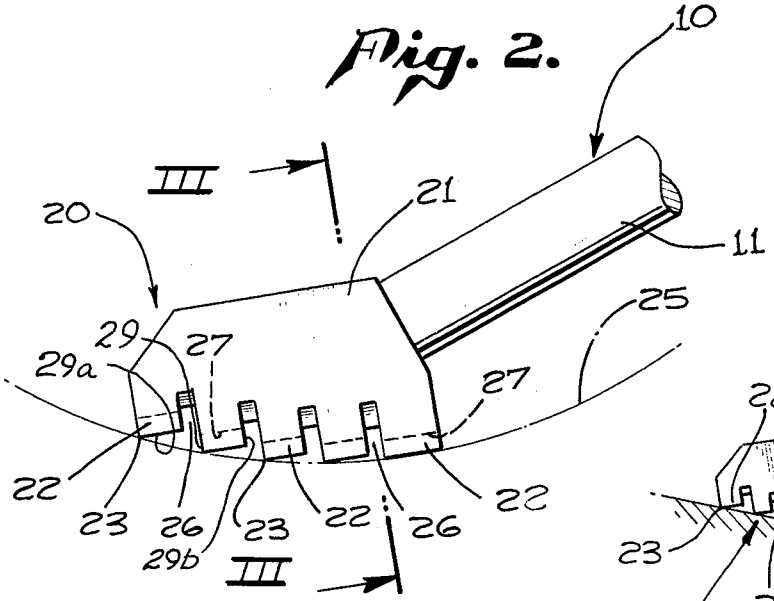
FIG. 2 is a side view of the tool body and part of the shank of one embodiment of the instant invention.

In the other exemplary embodiment, the connecting means between the tool body and the shank is merely a weld or other non-movable connection between the two parts. Normally, the angle of the shank 11 to the bottom face of the rear cutting tooth is less than 45° but it is preferable that the axis of the shank extend between the front and rear tooth. In order to change the depth and speed of cut, the angle which the shank makes with the workpiece is changed and this rotates the tool body relative to the workpiece. In FIG. 2, the curved array embodiment, this rotation will cause a different angle of attack between the cutting edges and the workpiece and will vary the depth and speed of cut of the tool. As the cutting tool is rotated in a counterclockwise direction in FIG. 2, the force component along the shank 11 will become more vertical. This will increase the depth of cut. At the same time, however, there will be a reduction in the horizontal component of force and this will lead to a decrease in the forward motion of the tool.

Because of the curvature of the array, it should be recognized that the vertical spacing of the teeth increase from the rear of the tool to the front. While the horizontal spacing remains relatively equal, the vertical spacing is a function of 1-cos *a* (if the curve array is circular) when the angle is measured at the center of the circle and 0° is the vertical position. It can be recognized that increasing the vertical spacing also increases the absolute spacing between cutting edges 23. The spacing is important because when the tool is pivoted upward, the wider spacing of the front teeth causes fewer teeth to contact the workpiece thereby concentrating the cutting force on one or two teeth. The tool, therefore, initially cuts in a small location. However, as the shank is tilted down, more teeth engage the workpiece for faster cutting over a large area. Note that the above geometry assumes that the connection of the shank to the tool is not at the center of the circle of the array.

It should be understood that the embodiment having a flat array of cutting teeth could have a fixed shank rather than a pivoted one. Depth and speed of cut would then be regulated by changing the force on the tool through handle 28. It would also be possible to provide the curved array embodiment with a pivot between the shank and the tool body.

In use, the curved array embodiment is started at a somewhat vertical angle. In that position, the front tooth or teeth contact the concrete and remove material. As more material is removed, the third tooth contacts the concrete. When the tooth has thus dug into the concrete, the angle of the tool to the workpiece is changed to the horizontal so that the rear teeth cut into the material. The increased horizontal force increases forward motion of the tool along the concrete. Vertical force on the tool is provided by the user exerting downward force on the tool body. A handle may be provided for the operator similar to that shown in FIG. 4.

Figure 6:
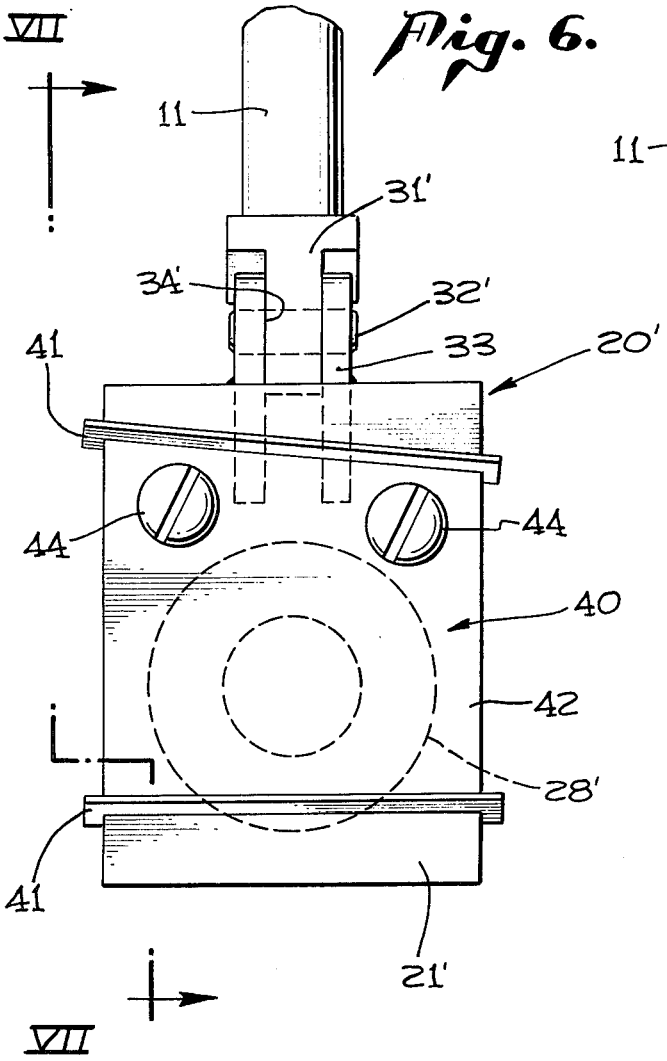
FIG. 6 is a bottom view of an alternative embodiment wherein the tool body comprises a paint scraping head.
Figure 7:
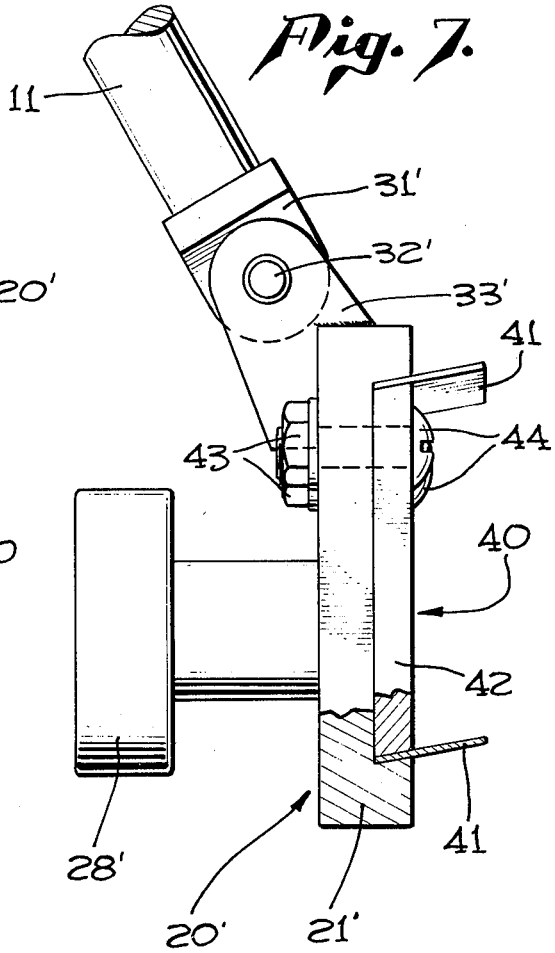
FIG. 7 is a cross-sectional view taken through plane VII—VII of the paint scraping head of FIG. 6.

Another embodiment of the invention is shown in FIGS. 6 and 7. In that embodiment, the cutting teeth comprise a pair of cutting blades. This embodiment is more useful in scraping operations; for example, in paint removing or light planing operations. The tool body 20′ has a handle 28′ and a connecting means 30′ connecting the tool body 20′ with the shank 11. The elements of the connecting means correspond to similar elements of the connecting means in the embodiment shown in FIG. 4.

The tool body 20′ has means 40 for mounting the scrapers 41 against the head 21′. The mounting means 40 comprises a wedged shaped mounting plate 42 which holds the scrapers in the position shown in FIGS. 6 and 7. The mounting plate is securely fastened by securing means which, in the preferred embodiment, comprise nuts 43 and bolts 44. The bolts pass through apertures in the head 21′ and through elongated holes in the mounting plate 42 so that the plate 42 can be adjusted in position to securely hold the blades.

Figure 4:
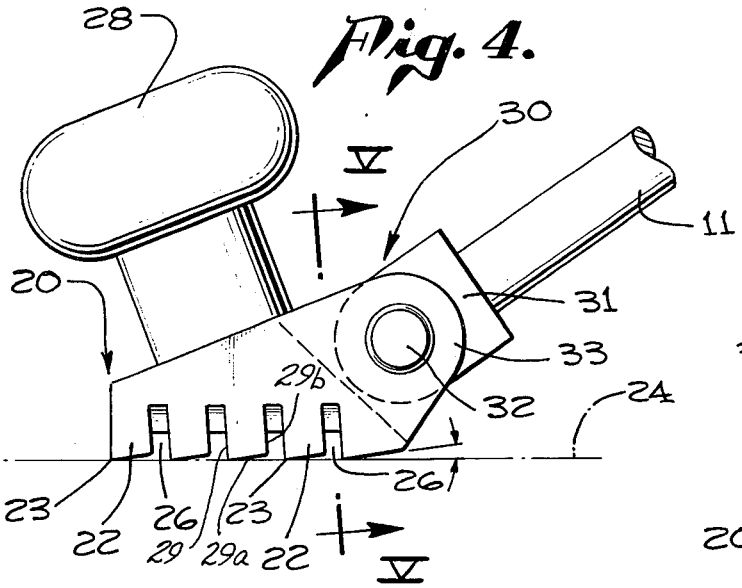
FIG. 4 is a side view of another embodiment of the instant invention showing the tool body, the shank, and the pivotal force transmitting connection.
Figure 5:
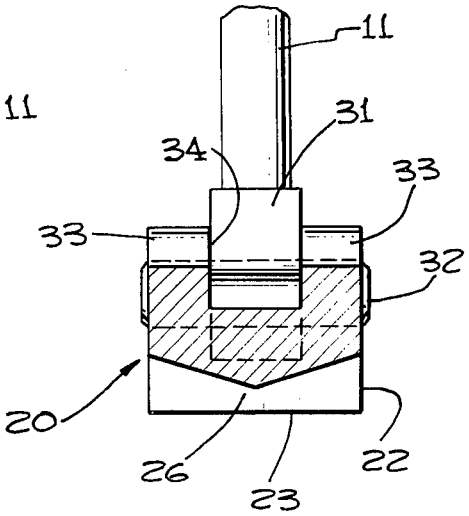
FIG. 5 is a cross-sectional view through plane V—V on the tool body in FIG. 4.

As with the embodiment shown in FIG. 4, the FIGS. 6 and 7 embodiment utilizes the pivotal force transmitting connection connecting the shank and the tool body whereby the vertical and horizontal force components of the power driven hammer are variable without varying the inclination of the tool body toward the workpiece. For lightweight jobs such as simple paint scraping where speed of the scraping operation is of primary concern, the shank would be rotated toward its horizontal position if little downward pressure is required. However, if more downward pressure is needed, the vertical component of the force transmitted from the power hammer may be increased by rotating counterclockwise the shank 11. The vertical component would also be increased by extering more force on the handle 28′. It should be recognized, however, that increasing downward pressure by increasing the vertical component of the force, decreases the horizontal component of force and, therefore, lowers the forward speed of the tool.

Thus, a cutting tool 10 for use generally with a power driven hammer 1 and means associated therewith for positioning the shank 11 in force transmitting relation has ben shown which meet the aforestated objects.

It will be understood that various modifications and changes may be made in the configuration described above which may come within the spirit of this invention, and all such changes and modifications coming within the scope of the appended claims are embraced thereby.

I claim:

1. A cutting tool having a forward end and a rear end and having means associated therewith for positioning a shank on the rear end thereof in force transmitting relation, said tool comprising:

a tool body having generally parallel and spaced cutting teeth means associated therewith for cutting into a workpiece under action of said tool, each cutting tooth having a cutting edge formed by the intersection of a forward face and a bottom face, each forward face being generally parallel with each other forward face and each bottom face being generally parallel with each other bottom face;

shank means for receiving power from a source of power;

means for connecting said shank means and said tool body in force transmitting relation; and cutting disposal groove means between said cutting teeth means, said cutting disposal groove means being generally tapered from the center of the tooth to widen at the sides.

2. A cutting tool having a forward end, a rear end and a shank on the tool, said tool comprising:

a tool body having cutting teeth means associated therewith for cutting into a workpiece under action of said tool, said cutting teeth means comprising a plurality of cutting edges disposed in a progressively widening spaced array relative to each other from the rear end to the front end of the cutting tool;

shank means for receiving power from a source of power; and means for connecting said shank means and said tool body in force transmitting relation, said connecting mean including means on the cutting tool for mounting said shank on the rear of the cutting tool and inclined thereto for directing force applied to the shank to the tool in a direction intermediate the front and rear cutting edges in both a downwardly and forwardly directed manner to assist in shearing material off the workpiece.

3. The cutting tool of claim 2 wherein said means mounting said shank to said tool mounts said shank at an angle of less than 45° to a plane of the bottom face of the rear cutting tooth.

4. The cutting tool of claim 2 further comprising a cutting disposal groove between each cutting tooth, said cutting disposal groove tapering from the center of the tooth to widen at the sides of the tooth to assist in removal of material from the tool.

5. The cutting tool of claim 4 wherein said cutting teeth are arranged in a longitudinally curved array.

6. The cutting tool of claim 2 wherein the spacing of said cutting edges is substantially equal in a horizontal reference plane but progressively more widely spaced in a vertical reference plane.

7. The cutting tool of claim 2 wherein each cutting tooth has a cutting edge formed by the intersection of a forward face and a bottom face, each forward face being generally parallel with each other forward face and each bottom face being generally parallel with each other bottom face.

8. A cutting tool having a forward end, a rear end and a shank on the tool, said tool comprising:

a tool body having cutting teeth means associated therewith for cutting into a workpiece under action of said tool, said cutting teeth means comprising a plurality of cutting edges disposed in an array from the front end to the rear end of the cutting tool;

shank means for receiving power from a source of power;

means for connecting said shank means and said tool body in force transmitting relation, said connecting means including means on the cutting tool for hingedly mounting said shank on the rear of the cutting tool to be thereby movable in various inclined directions thereto for directing force applied to the shank initially to the tool rear cutting edge and thereafter intermediate the forward and rear ends of the tool in both a downwardly and forwardly directed manner to assist in shearing material off the workpiece; and a cutting disposal groove between each cutting tooth, said cutting disposal groove tapering from the center of the tooth to widen at the sides of the tooth to assist in removal of material from the tool.

* * * * *

UNITED STATES PATENT AND TRADEMARK OFFICE

CERTIFICATE OF CORRECTION

PATENT NO. : 4,027,647

DATED : June 7, 1977

INVENTOR(S) : Herbert H. Hoffman

It is certified that error appears in the above-identified patent and that said Letters Patent are hereby corrected as shown below:

Column 1, line 44, insert - - a - - after "is" and before "primary". Column 6, in Claim 2, line 31 of column 6, change "mean" to - - means - -.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*